US005622243A

United States Patent [19]

Kang

[11] Patent Number: 5,622,243

[45] Date of Patent: Apr. 22, 1997

[54] CORD WINDER FOR A VACUUM CLEANER

[75] Inventor: Sang-Bo Kang, Incheon, Rep. of Korea

[73] Assignee: Daewoo Electronics Co., Ltd., Seoul, Rep. of Korea

[21] Appl. No.: 562,883

[22] Filed: Nov. 27, 1995

[30] Foreign Application Priority Data

Nov. 26, 1994 [KR] Rep. of Korea ..... 94-31373 U

[51] Int. Cl.[6] ..... H02G 11/02; B65H 75/30

[52] U.S. Cl. ..... 191/12.2 R; 242/381.6

[58] Field of Search ..... 191/12.2 R, 12.4, 191/12.2 A; 242/381.6, 385.4

[56] References Cited

U.S. PATENT DOCUMENTS

| | | | |
|---|---|---|---|
| 2,393,511 | 1/1946 | Beede | 242/385.4 X |
| 2,937,395 | 5/1960 | Meyerhoefer | 191/12.2 R X |
| 2,937,396 | 5/1960 | Momberg et al. | 191/12.2 R X |
| 3,339,030 | 8/1967 | Nilsson | 191/12.2 R |
| 5,255,768 | 10/1993 | Kasper et al. | 191/12.2 R |

FOREIGN PATENT DOCUMENTS

| | | | |
|---|---|---|---|
| 0488074 | 6/1992 | European Pat. Off. . | |
| 3139819 | 4/1983 | Germany | 191/12.2 R |
| 8402185 | 4/1984 | Germany . | |
| 3523213 | 1/1987 | Germany | 191/12.4 |
| 8706363 | 10/1988 | Germany . | |
| 8803133 | 8/1989 | Germany . | |
| 4008333 | 1/1992 | Japan | 191/12.4 |
| 2251179 | 7/1992 | United Kingdom . | |

OTHER PUBLICATIONS

*Patent Abstracts of Japan,* Publication No. JP7051201, Publication Date: Feb. 28, 1995, Application No. JP930198122, Application Date: Aug. 10, 1993, Inventors: Okamoto Masafumi, et al., Patent Date: Feb. 28, 1995, Title: Vacuum Cleaner.

*Patent Abstracts of Japan,* Publication No. JP4303375, Publication Date: Oct. 27, 1992, Application No. JP910066097, Application Date: Mar. 29, 1991, vol. 17, No. 120, Inventor: Hayashi Kazumasa, Patent Date: Oct. 27, 1992, Title: Cord Wind-Up Device For Vacuum Cleaner.

*Primary Examiner*—Karen B. Merritt
*Assistant Examiner*—Scott L. Lowe
*Attorney, Agent, or Firm*—Beveridge, DeGrandi, Weilacher & Young, L.L.P.

[57] ABSTRACT

Disclosed is a cord winder for a vacuum cleaner which is easily operated and reduces the volume of the vacuum cleaner. The cord winder has a reel for winding the power cord thereon, an actuator rod formed integrally with a button, and a stopper rod with a stopper wheel guided horizontally along a guide channel by the actuator rod, thereby braking the rotation of the reel. When the user presses the button, the actuator rod goes downward. Then, the inclined surface of the actuator rod slides along the inclined surface of the stopper rod, while pushing the stopper rod leftward, and thereby releasing the rigid contact between the stopper wheel and the reel.

13 Claims, 4 Drawing Sheets

CORD WINDER FOR A VACUUM CLEANER

BACKGROUND OF THE INVENTION

1. Field of the Invention

The present invention relates to a vacuum cleaner, and more particularly to a cord winder for a vacuum cleaner which can be easily operated, and which requires less space, thereby reducing the volume of the vacuum cleaner.

2. Prior Arts

Vacuum cleaner assemblies are used in a wide variety of applications and environments. In general, a vacuum cleaner is powered by a DC current power supplied through a battery accommodated in the vacuum cleaner or by an AC power source via an AC plug outlet in the wall of a building, house or other like structure. Therefore, it is usually necessary to use a power cord which is either fixedly or releasably coupled to the vacuum cleaner to conduct AC power to the vacuum cleaner.

When a vacuum cleaner is not in use, the power cord, if it is fixedly secured to the cleaner, must typically be wound upon a portion of the cleaner or otherwise wound up to prevent it from being damaged or severed from the vacuum cleaner. Thus, it is usually necessary after each use of the vacuum cleaner assembly to wind up the power cord associated therewith and unwind it the next time the assembly is used. The need to manually wind and unwind the power cord with each use of a vacuum cleaner can detract from the convenience from using the cleaner.

U.S. Pat. No. 5,255,768 issued to Kasper et al. discloses a cord winder for a vacuum cleaner which enables a power cord associated with the cleaner to be stored within the cleaner when it is not in use and quickly and easily removed therefrom when it is to be used. Kasper et al.'s cord winder comprises a spool upon which a power cord is wound and which is disposed coaxially with a driving motor in a cylindrical housing, a spring associated with the spool to rotate the spool in a direction operable to retract the power cord coupled thereto when the power cord has been at least partially unwound from the spool, and a brake assembly for releasably maintaining the spool in a desired position once at least a portion of the power cord has been unwound from the spool.

The brake assembly comprises a pair of Y-shaped frame members, a pair of pivot posts or pivotally supporting the Y-shaped frame members at the center thereof, a manually depressible tab member, a rubber brake wheel, and coil spring for applying a biasing force to the rubber brake wheel. A user can wind the power cord on the spool or releasably maintain the spool in a desired position once at least a portion of the power cord has been unwound from the spool by handling the tab member.

However, Kasper et al.'s cord winder is proper for a cord winder in which a spool is disposed coaxially with a driving motor in a cylindrical housing, but not for the extensively used commercial canister-type vacuum cleaner.

In the meantime, FIG. 5 is a schematic sectional view of a conventional cord winder 10 which is usually installed in a canister 20 of a canister-type vacuum cleaner as shown in FIG. 1. Cord winder 10 has a construction similar to that of Kasper et al.'s. Cord winder 10 has a reel 32 and L-shaped lever 12 installed in a reel chamber 30 defined in canister 20. A compression coil spring 18 is disposed between L-shaped lever 12 and the ceiling of reel chamber 30, so as to apply a clockwise biasing force to L-shaped lever 12. L-shaped lever 12 is pivotal about a hinge pin 16 by a button 22 disposed above and being in contact with one end of L-shaped lever 12.

A friction strip 34 is attached on the rear wall of reel chamber 30, and a stopper wheel 14 is mounted on the other end of L-shaped lever 12. Stopper lever 12 is located between friction strip 14 and the periphery of reel 30. Friction strip 34 has a vertical surface **34*a* and an inclined surface 34*b* as shown in FIG. 5. Meanwhile, a torsion spring member (not shown) is installed in reel 32** so as to apply a clockwise biasing force thereto.

When a user pulls out a power cord 24 out of canister 20, reel 32 rotates counter-clockwise, and accordingly stopper wheel 14 rotates clockwise while rolling up along inclined surface **34*b* . Therefore, power cord 24** is pulled out smoothly.

When the user presses button 22, L-shaped lever 12 pivots counter-clockwise against the clockwise biasing force of compression coil spring 18. In this case, stopper wheel 14 rolls up along inclined surface **34*b* , thereby releasing the close contact between stopper wheel 14 and the periphery of reel 32. Accordingly, reel 32 rotates clockwise by the biasing force of the torsion spring member therein, thereby winding power cord 24** thereon.

When the user stops pressing button 22, L-shaped lever 12 pivots clockwise again by the biasing force of compression coil spring 18, and thereby stopper wheel 14 comes into close contact with the periphery of reel 30 again. Then, the clockwise rotation of reel 30 is stopped, and power cord 24 is releasably maintained at that position.

However, conventional cord winder 10 having the above construction is inconvenient to use since button 22 must be located in the middle of canister 20, and it has a disadvantage in its volume since L-shaped lever 12 takes up a relatively large space in reel chamber 30.

SUMMARY OF THE INVENTION

The present invention has been made to overcome the above described problems of the prior arts, and accordingly it is an object of the present invention to provide a cord winder for a vacuum cleaner which can be easily operated, and which takes up a reduced space, thereby reducing the volume of the vacuum cleaner.

To achieve the above object, the present invention provides a cord winder for a vacuum cleaner, the cord winder comprising:

a reel for winding a power cord on the reel by means of a first biasing force, the reel installed in a reel chamber defined in a canister of the vacuum cleaner, the reel chamber having a friction strip attached on an inner surface of a ceiling of the reel chamber;

a brake section including a stopper rod, a stopper wheel disposed between the friction strip and a periphery of the reel, and a stopper pin fixed to a front end of the stopper rod, the stopper pin extending through and rotatably supporting the stopper wheel, the stopper wheel being in close contact with the friction strip and the periphery of the reel simultaneously at a first position, thereby preventing the reel from being rotated by the first biasing force;

a guide member disposed at an upper part of a side wall of the reel chamber, the guide member having a horizontal guide channel defined in the guide member, the stopper rod being guided horizontally in the guide channel;

a stopper torsion spring for applying a second biasing force to the brake section so as to maintain the brake section at the first position, the stopper torsion spring disposed under the guide member;

a release means for separating the brake section from the first position while overcoming the second biasing force;

a button for operating the release means, the button constituting a rear upper end of the canister; and a biasing means for applying an upward third biasing force to the button.

Preferably, the guide member has an elongated first branch hole formed at a lower surface of the guide member, the first branch hole extending longitudinally, the stopper rod in the guide channel having a second branch hole formed at a lower surface of the stopper rod, the second branch hole being in alignment with the first branch hole, the stopper torsion spring having a spring branch inserted through the first branch hole into the second branch hole, thereby the stopper torsion spring applying a second biasing force toward the first position to the stopper rod.

More preferably, the release means includes an actuator rod integrally formed with and extending downward from the button, the stopper rod having a first inclined surface formed at a rear end of the stopper rod, the actuator rod having a second inclined surface formed at a lower end of the actuator rod, the second inclined surface sliding along the first inclined surface while pushing the stopper rod, thereby separating the brake section from the first position, when the button is pressed.

The button includes a horizontally extending upper portion forming a portion of an upper surface of the canister and a curved rear portion forming a portion of a rear surface of canister, and the actuator rod extends downward from a rear end of the upper portion of the button.

A pivot tab extends downward from a front portion of the upper portion of the button, and a pivot pin is fixed to the canister extends through the pivot tab so as to permit the button to pivot about the pivot pin.

The biasing means includes a compression coil spring installed behind the pivot tab and between the button and an outer surface of the ceiling.

In the cord winder for a vacuum cleaner according to the present invention as described above, once a user presses the button, the actuator rod goes downward. Then, the inclined surface of the actuator rod comes into contact with and slides along the inclined surface of the stopper rod. Accordingly, the stopper rod is pushed leftward, and the rigid contact between the stopper wheel and the reel is released.

When the user stops pressing the button, the button ascends by the biasing force of the compression coil spring, and the actuator rod ascends accordingly. At this time, the stopper rod is pushed rightward by the rightward biasing force of the stopper torsion spring. Also, the stopper wheel comes into contact with the friction strip and the outer periphery of the reel simultaneously at its right-end position, thereby preventing the clockwise rotation of the reel.

BRIEF DESCRIPTION OF THE DRAWINGS

The above object, and other features and advantages of the present invention will become more apparent by describing in detail preferred embodiments thereof with reference to the attached drawings, in which.

DESCRIPTION OF THE PREFERRED EMBODIMENTS

A preferred embodiment of the present invention will be described in detail with reference to the accompanying drawings.

Figure 1:
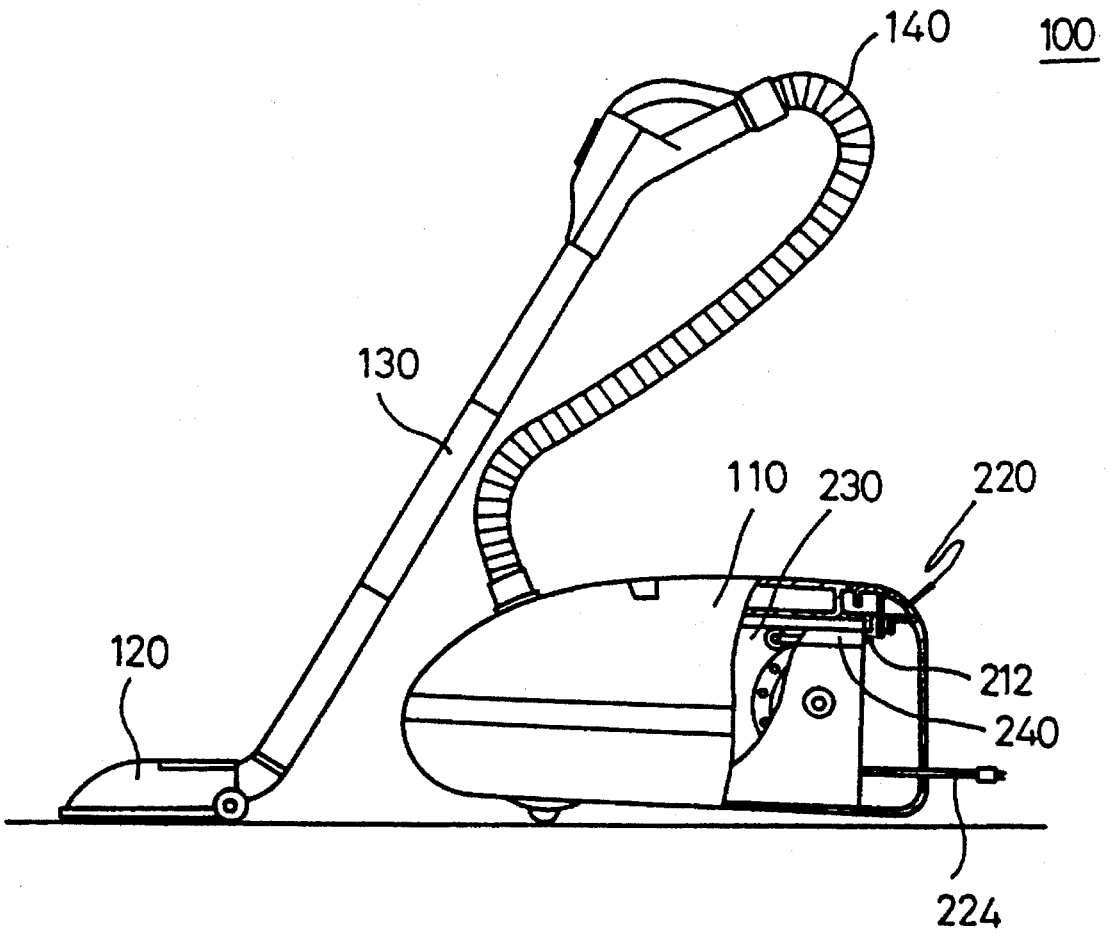
FIG. 1 is a partly cut-out schematic side elevation of a canister-type vacuum cleaner having a cord winder according to one embodiment of the present invention.

FIG. 1 schematically illustrates a canister-type vacuum cleaner 100 which includes a canister 110, a brush separated from canister 110, an extension pipe 130 and a flexible hose 140 for connecting brush 120 to canister 110. Canister 110 is equipped with a cord winder 200 according to one embodiment of the present invention.

Figure 2:
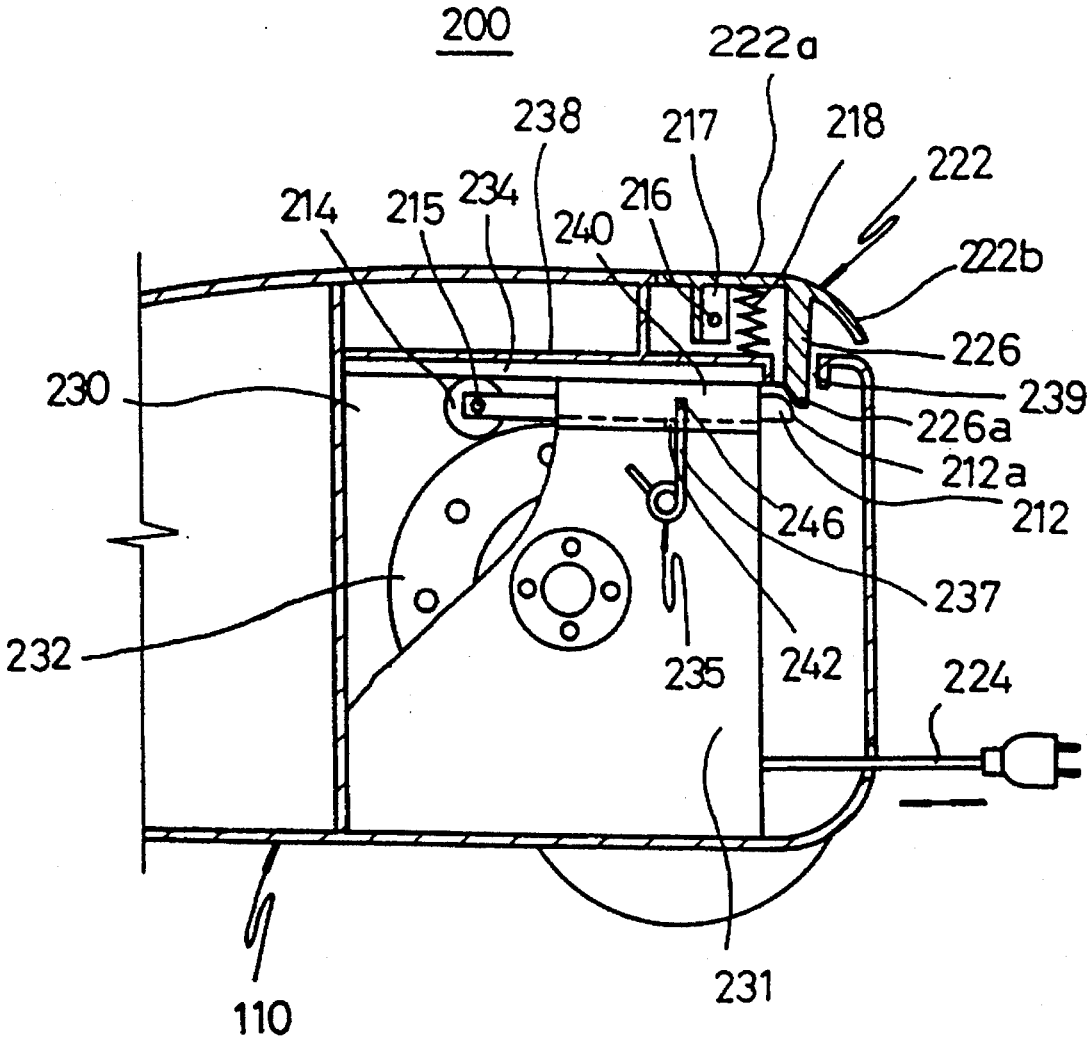
FIG. 2 is a side sectional view of the cord winder shown in FIG. 1.

FIG. 2 is a side sectional view, with parts broken away, illustrating cord winder 200 shown in FIG. 1 in detail.

Cord winder 200 includes a reel 232 within a reel chamber 230 defined in canister 110 of vacuum cleaner 100. A reel torsion spring member (not shown) is installed within reel 232 for applying a clockwise biasing force to reel 232.

A button 222 is provided to the rear end of the upper surface of canister 110. Button 222 has a horizontally extending upper portion **222*a* forming one portion of the upper surface of canister 110 and a curved rear portion 222*b* forming one portion of the rear surface of canister 110**.

A pivot tab 217 extends in the vertical downward direction in the vicinity of the front end of upper portion **222*a* of button 222. A pivot pin 216 fixed to canister 110 penetrates into pivot tab 217 so as to permit button 222 to swing about pivot pin 216**.

An actuator rod 226 extends through an actuator rod hole 239 from the rear end of upper portion **222*a* of button 222 in the downward vertical direction. Actuator rod hole 239 is formed in the rear end of a ceiling 238 of reel chamber 230. An inclined surface 226*a* is formed to a lower end of actuator rod 226**.

A compression coil spring 218 is installed behind pivot tab 217 and between button 222 and the outer surface of ceiling 238, so that a counter-clockwise biasing force is exerted upon button 222 by compression coil spring 218.

A friction strip 234 is attached to the inner surface of ceiling 238 of reel chamber 230.

Figure 4:
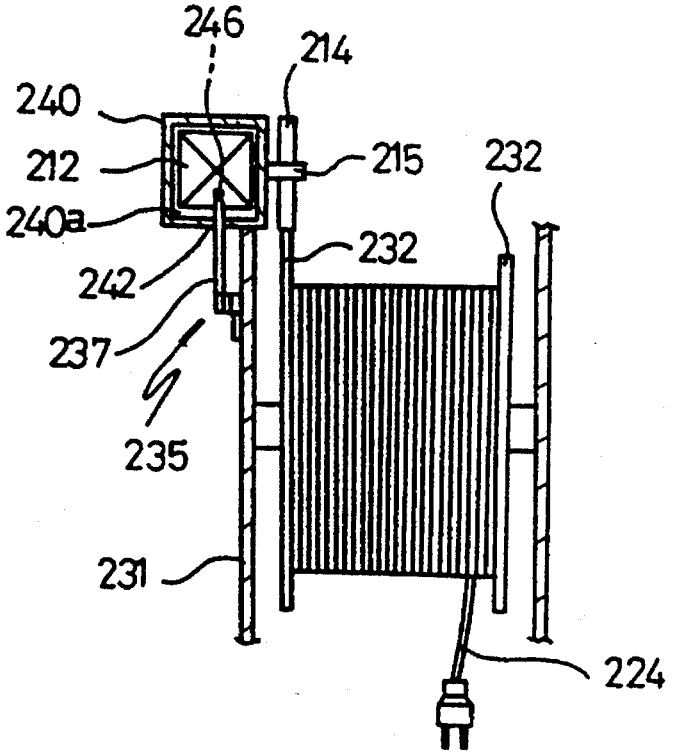
FIG. 4 is a side elevation of a reel and a brake section in the cord winder shown in FIG. 1.
Figure 5:
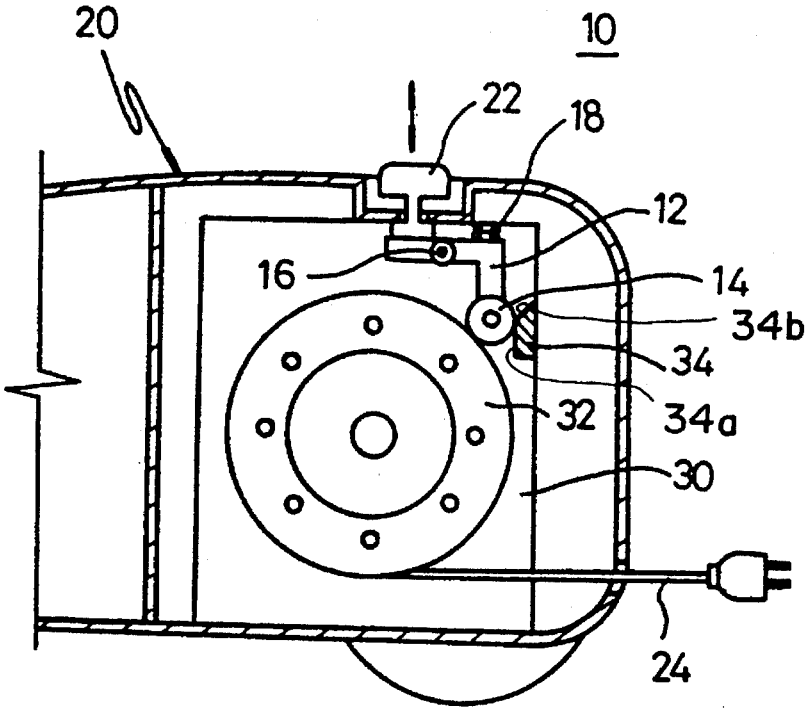
FIG. 5 (PRIOR ART)
FIG. 5 is a side sectional view of a conventional cord winder.

Meanwhile, as shown in FIG. 4, a guide member 240 is installed to an upper portion of a side wall 231 of reel chamber 230. Guide member 240 has a shape of a hollow square pillar, so as to define a guide channel **240*a* having a rectangular section therein. A stopper rod 212 is inserted in guide channel 240*a*** and guided therein.

Stopper rod 212 has an inclined surface **212*a* formed at a rear end thereof and being in contact with inclined surface 226*a* of actuator rod 226. A stopper pin 215 is fixed to the front end of stopper rod 212. Stopper pin 215 penetrates through and rotatably supports a stopper wheel 2 14. Consequently, stopper wheel 214 is in parallel with guide member 240, and placed between the outer periphery of reel 232 within reel chamber 230 and friction strip 234**.

A vertically-elongated first branch hole 242 is formed in a lower surface of guide member 240, and a second branch hole 246 in alignment with first branch hole 242 is formed to a lower surface of stopper rod 212 within guide channel 240*a*.

Figure 3:
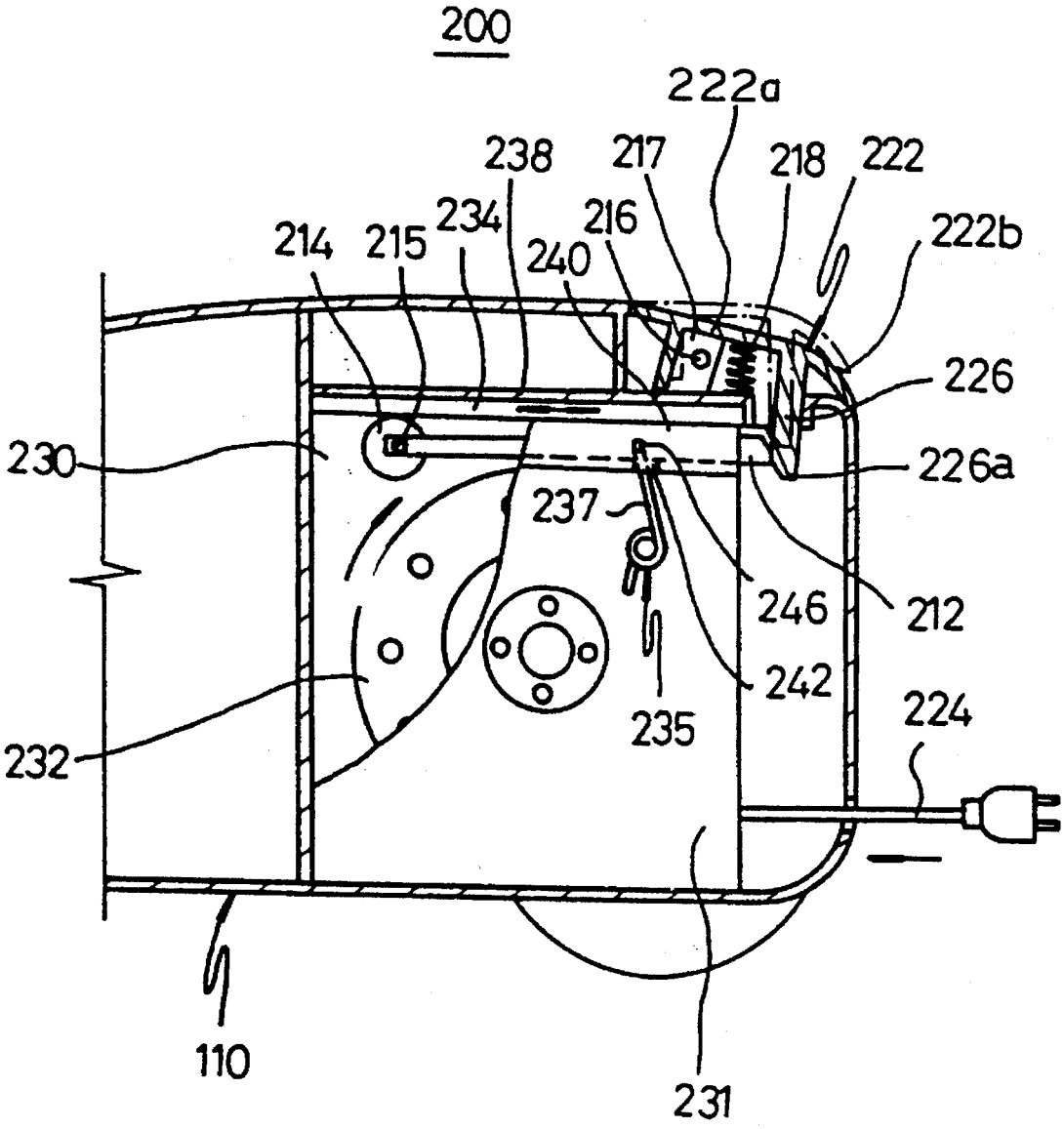
FIG. 3 is a side sectional view of the cord winder of FIG. 1 in which the button is pressed.

On the other hand, a stopper torsion spring 235 is disposed on the outer surface of side wall 23 1 of reel chamber 230 under guide member 240. Stopper torsion spring 235 has a spring branch 237 extending through first branch hole 242 to be inserted in second branch hole 246. Accordingly, as shown in FIGS. 2 and 3, stopper torsion spring 235 normally imposes a biasing force in a forward direction upon stopper rod 212.

Hereinbelow, an operation of the cord winder constructed as above will be described with reference to FIGS. 2 and 3.

Initially, under the state that button 222 is not pressed, as shown in FIG. 2, button 222 is maintained at its uppermost position by means of the biasing force of compression coil spring 218, and stopper rod 212 is maintained at its right-end position by means of the rightward biasing force of stopper torsion spring 235. At this time, stopper wheel 214 comes into contact with friction strip 234 and the outer periphery of reel 232 simultaneously, thereby preventing the clockwise rotation of reel 232.

When the user pulls out a power cord 224 out of canister 110, reel 232 rotates counter-clockwise, and accordingly stopper wheel 214 rotates clockwise while rolling along friction strip 234. Therefore, the extraction of power cord 24 becomes smooth.

Once a user presses button 222, actuator rod 226 goes downward. Then, inclined surface 226*a* of actuator rod 226 comes into contact with and slides along inclined surface 212*a* of stopper rod 212, as shown in FIG. 3. Accordingly, stopper rod 212 is pushed leftward, and stopper wheel 214 rolls leftward along friction strip 234. Thus, the rigid contact between stopper wheel 214 and reel 232 is released.

In this case, the unshown reel torsion spring exerts its clockwise biasing force upon reel 232. Therefore, reel 232 is rotated clockwise by the biasing force of the reel torsion spring, so as to wind power cord 224 on reel 232. If the user draws out power cord 224 while overcoming the biasing force of the reel torsion spring, reel 232 is rotated counter-clockwise and power cord 224 is taken out.

When the user releases the pressing of button 222, button 222 ascends by the biasing force of compression coil spring 218. Then, actuator rod 226 ascends. At this time, stopper rod 212 is pushed rightward by the rightward biasing force of stopper torsion spring 235. Also, stopper wheel 214 rolls along friction strip 234 to come into contact with friction strip 234 and the outer periphery of reel 232 simultaneously at its right-end position as shown in FIG. 2, thereby preventing the clockwise rotation of reel 232.

In the cord winder according to the present invention as described above, button 222 is provided to the rear end of canister 110 of the vacuum cleaner making it more convenient to the user. In addition, a pivoting L-shaped lever 12 in the prior art is not employed, but horizontally-moving stopper rod 212 and stopper wheel 214 are adopted to brake the rotation of reel 232 in the present invention. Thus, the brake assembly of the present invention including stopper rod 212 and stopper wheel 214 instead of the L-shaped lever occupies a reduced space within canister 110 of the vacuum cleaner, thereby minimizing the size of canister 110 of the vacuum cleaner.

Furthermore, the cord winder according to the present invention is available for a vacuum cleaner of any size only by adjusting the length of stopper rod 212. Moreover, button 222 is placed to the rear end to partially constitute canister 110 of the cleaner, thereby providing a favorable aesthetic enhancement in designing the vacuum cleaner.

While the present invention has been particularly shown and described with reference to the particular embodiment thereof, it will be understood by those skilled in the an that various changes in form and details may be effected therein without departing from the spirit and scope of the invention as defined by the appended claims.

What is claimed is:

1. A cord winder for a vacuum cleaner, the cord winder comprising:

a reel for winding a power cord on the reel by means of a first biasing force, the reel installed in a reel chamber defined in a canister of the vacuum cleaner, the reel chamber having a friction strip attached on an inner surface of a ceiling of the reel chamber;

a first means for cooperating with the friction strip at a first position, thereby preventing the reel from being rotated by the first biasing force;

a second means for guiding the first means, as the first means is moved horizontally;

a third means for applying a second biasing force to the first means so as to maintain the first means at the first position;

a fourth means for separating the first means from the first position while overcoming the second biasing force;

a button for operating the fourth means, the button constituting a rear upper end of the canister; and a fifth means for applying an upward third biasing force to the button.

2. A cord winder as claimed in claim 1, wherein the first means comprises a stopper rod, a stopper wheel disposed between the friction strip and a periphery of the reel, and a stopper pin fixed to a front end of the stopper rod, the stopper pin extending through and rotatably supporting the stopper wheel, the stopper wheel being in close contact with the friction strip and the periphery of the reel simultaneously when the first means is located in the first position.

3. A cord winder as claimed in claim 2, wherein the fourth means comprises an actuator rod integrally formed with and extending downward from the button, the stopper rod having a first inclined surface formed at a rear end of the stopper rod, the actuator rod having a second inclined surface formed at a lower end of the actuator rod, the second inclined surface sliding along the first inclined surface while pushing the stopper rod, thereby separating the first means from the first position, when the button is pressed.

4. A cord winder as claimed in claim 1, wherein the second means comprises a guide member disposed at an upper part of a side wall of the reel chamber, the guide member having a shape of a hollow square pillar, thereby having a guide channel defined in the guide member, the guide channel having a rectangular cross-section.

5. A cord winder as claimed in claim 4, wherein the third means comprises a stopper torsion spring disposed under the first means.

6. A cord winder for a vacuum cleaner, the cord winder comprising:

a reel for winding a power cord on the reel by means of a first biasing force, the reel installed in a reel chamber defined in a canister of the vacuum cleaner, the reel chamber having a friction strip attached on an inner surface of a ceiling of the reel chamber;

a brake section including a stopper rod, a stopper wheel disposed between the friction strip and a periphery of the reel, and a stopper pin fixed to a front end of the stopper rod, the stopper pin extending through and rotatably supporting the stopper wheel, the stopper wheel being in close contact with the friction strip and the periphery of the reel simultaneously at a first position, thereby preventing the reel from being rotated by the first biasing force;

a guide member disposed at an upper part of a side wall of the reel chamber, the guide member having a horizontal guide channel defined in the guide member, the stopper rod being guided horizontally in the guide channel;

a stopper torsion spring for applying a second biasing force to the brake section so as to maintain the brake section at the first position, the stopper torsion spring disposed under the guide member;

a release means for separating the brake section from the first position while overcoming the second biasing force;

a button for operating the release means, the button constituting a rear upper end of the canister; and a biasing means for applying an upward third biasing force to the button.

7. A cord winder as claimed in claim 6, wherein the guide member has an elongated first branch hole formed at a lower surface of the guide member, the first branch hole extending longitudinally, the stopper rod in the guide channel having a second branch hole formed at a lower surface of the stopper rod, the second branch hole being in alignment with the first branch hole, the stopper torsion spring having a spring branch inserted through the first branch hole into the second branch hole, thereby the stopper torsion spring applying a second biasing force toward the first position to the stopper rod.

8. A cord winder as claimed in claim 6, wherein the release means comprises an actuator rod integrally formed with and extending downward from the button, the stopper rod having a first inclined surface formed at a rear end of the stopper rod, the actuator rod having a second inclined surface formed at a lower end of the actuator rod, the second inclined surface sliding along the first inclined surface while pushing the stopper rod, thereby separating the brake section from the first position, when the button is pressed.

9. A cord winder as claimed in claim 6, wherein the button comprises a horizontally extending upper portion forming a portion of an upper surface of the canister and a curved rear portion forming a portion of a rear surface of the canister, and the release means comprises an actuator rod extending downward from a rear end of the upper portion of the button.

10. A cord winder as claimed in claim 9, wherein a pivot tab extends downward from a front portion of the upper portion of the button, and a pivot pin fixed to the canister extends through the pivot tab so as to permit the button to pivot about the pivot pin.

11. A cord winder as claimed in claim 10, wherein the biasing means comprises a compression coil spring installed behind the pivot tab and between the button and an outer surface of the ceiling.

12. A cord winder as claimed in claim 11, wherein the actuator rod extends through an actuator rod hole into the reel chamber, the actuator rod hole being formed in a rear end of the ceiling of the reel chamber, the actuator rod pushing the stopper rod when the button is pressed, thereby separating the brake section from the first position.

13. A cord winder for a vacuum cleaner, the cord winder comprising:

a reel for winding a power cord on the reel by means of a first biasing force, the reel installed in a reel chamber defined in a canister of the vacuum cleaner, the reel chamber having a friction strip attached on an inner surface of a ceiling of the reel chamber;

a brake section including a stopper rod, a stopper wheel disposed between the friction strip and a periphery of the reel, and a stopper pin fixed to a front end of the stopper rod, the stopper rod having a first inclined surface formed at a rear end of the stopper rod, the stopper rod having a first branch hole formed at a lower surface of the stopper rod, the stopper pin extending through and rotatably supporting the stopper wheel, the stopper wheel being in close contact with the friction strip and the periphery of the reel simultaneously at a first position, thereby preventing the reel from being rotated by the first biasing force;

a guide member disposed at an upper part of a side wall of the reel chamber, the guide member having an elongated second branch hole formed at a lower surface of the guide member, the second branch hole extending longitudinally and being in alignment with the first branch hole, the guide member having a horizontal guide channel defined in the guide member so that the stopper rod is guided horizontally in the guide channel;

a stopper torsion spring for applying a second biasing force to the brake section so as to maintain the brake section at the first position, the stopper torsion spring disposed under the guide member, the stopper torsion spring having a spring branch inserted through the first branch hole into the second branch hole;

a button having a horizontally extending upper portion forming a portion of an upper surface of the canister and a curved rear portion forming a portion of a rear surface of the canister, the button having a pivot tab extending downward from a portion of the upper portion of the button, and a pivot pin fixed to the canister and extending through the pivot tab so as to permit the button to pivot about the pivot pin;

an actuator rod formed integrally with and extending downward from a rear end of the upper portion of the button through an actuator rod hole into the reel chamber, the actuator rod hole being formed in a rear end of the ceiling of the reel chamber, the actuator rod having a second inclined surface formed at a lower end of the actuator rod, the second inclined surface sliding along the first inclined surface while pushing the stopper rod, thereby separating the brake section from the first position, when the button is pressed; and a compression coil spring for applying an upward third biasing force to the button, the compression coil spring being installed behind the pivot tab and between the button and an outer surface of the ceiling.

* * * * *